US011489301B2

(12) United States Patent
Yang et al.

(10) Patent No.: US 11,489,301 B2
(45) Date of Patent: Nov. 1, 2022

(54) ELECTRICAL CONNECTION MODULE AND POWER SUPPLY INTEGRATION STRUCTURE OF CONNECTION INTERFACE THEREOF

(71) Applicant: JESS-LINK PRODUCTS CO., LTD., New Taipei (TW)

(72) Inventors: Yun-Chang Yang, New Taipei (TW); Siang-Ting Wang, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 0 days.

(21) Appl. No.: 17/208,440

(22) Filed: Mar. 22, 2021

(65) Prior Publication Data

US 2022/0231471 A1 Jul. 21, 2022

(30) Foreign Application Priority Data

Jan. 20, 2021 (TW) ..... 110102174

(51) Int. Cl.

| | |
|---|---|
| ***H01R 24/60*** | (2011.01) |
| ***H01R 13/24*** | (2006.01) |
| ***H01R 13/40*** | (2006.01) |
| ***H01R 12/70*** | (2011.01) |
| ***H01R 12/53*** | (2011.01) |

(52) U.S. Cl.

CPC ..... *H01R 24/60* (2013.01); *H01R 12/53* (2013.01); *H01R 12/7005* (2013.01); *H01R 13/2407* (2013.01); *H01R 13/40* (2013.01)

(58) Field of Classification Search

CPC .... H01R 24/60; H01R 12/53; H01R 12/7005; H01R 13/2407

USPC ..... 439/660

See application file for complete search history.

(56) References Cited

U.S. PATENT DOCUMENTS

| | | | | |
|---|---|---|---|---|
| 6,705,885 | B1 * | 3/2004 | Lin | H01R 13/6335 439/160 |
| 6,786,759 | B1 * | 9/2004 | Lin | H01R 13/6335 439/483 |
| 8,057,266 | B1 * | 11/2011 | Roitberg | H01R 13/055 439/907 |
| 9,559,453 | B1 * | 1/2017 | Luo | H01R 13/113 |
| 9,680,248 | B1 * | 6/2017 | Chen | H01R 13/436 |
| 10,312,635 | B2 * | 6/2019 | Zhao | H01R 13/516 |

(Continued)

*Primary Examiner* — Alexander Gilman

(74) *Attorney, Agent, or Firm* — Chun-Ming Shih; HDLS IPR Services

(57) ABSTRACT

An electrical connection module and a power supply integration structure of a connection interface of the electrical connection module are disclosed. The electrical connection module includes a connection body and a terminal structure. The connection body has a jack communicating with the inside of the connection body for installing the terminal structure in the connection body to communicate with the jack. The terminal structure includes multiple terminals arranged in two rows. Each row has one or more power terminals. The power terminal in one row is defined as a positive pin, the power terminal of the other row is defined as a negative pin. An end of the power terminal in each row is electrically connected to a conductive part respectively. The electrical connection module is disposed across a power guide base, and the conductive part is in contact with the power guide base to for the power integration.

13 Claims, 6 Drawing Sheets

(56) References Cited

U.S. PATENT DOCUMENTS

| | | | | |
|---|---|---|---|---|
| 2003/0032316 | A1* | 2/2003 | Bassler | H01R 13/6471 439/108 |
| 2004/0242050 | A1* | 12/2004 | Ke | H01R 9/03 439/483 |
| 2006/0292933 | A1* | 12/2006 | van Meijl | H01R 13/6592 439/579 |
| 2009/0305530 | A1* | 12/2009 | Ito | H01R 13/447 439/80 |
| 2014/0148041 | A1* | 5/2014 | Orris | H01R 13/64 439/374 |
| 2015/0004835 | A1* | 1/2015 | Allwood | H01R 13/6589 439/607.25 |
| 2017/0162960 | A1* | 6/2017 | Wanha | H01R 13/6473 |
| 2018/0019542 | A1* | 1/2018 | Cai | H01R 12/721 |
| 2018/0120906 | A1* | 5/2018 | Reed | H05K 7/1487 |
| 2018/0138614 | A1* | 5/2018 | Zhao | H01R 13/26 |
| 2018/0151985 | A1* | 5/2018 | Zhang | H01R 13/6275 |
| 2019/0173237 | A1* | 6/2019 | Oosaka | H01R 9/0512 |
| 2020/0083625 | A1* | 3/2020 | Minich | H01R 12/737 |
| 2020/0235528 | A1* | 7/2020 | Wu | H01R 13/6593 |

* cited by examiner

ELECTRICAL CONNECTION MODULE AND POWER SUPPLY INTEGRATION STRUCTURE OF CONNECTION INTERFACE THEREOF

BACKGROUND OF THE DISCLOSURE

Technical Field

The technical field of this disclosure relates to an electrical connector, and more particularly to an electrical connection module applicable for a server, and a power supply integration structure of a connection interface of the electrical connection module.

Description of Related Art

In the related-art electrical connectors used for connecting hard disks and server/host systems, apart from providing circuit design such as hot swap, it is necessary to maintain the power supply continuously and prevent possible power disconnection, in order to ensure the normal operation of the server. Therefore, the related-art servers generally supply the required electric power to the connected data access devices (such as hard disks) to ensure the normal operation.

In general, a server is often connected with multiple data access devices or reserves some installation space for expansion and upgrade. Thus, each corresponding electrical connector requires a power cable for connecting to the power supply in order to continuously maintain the power supply and prevent power disconnection. However, such design lacks the consideration and advantage of integration and is inconvenient to manage or maintain.

In view of the aforementioned drawbacks, the discloser of this disclosure based on years of experience in the related industry to conduct extensive research and experiment, and finally provided a feasible solution to overcome the drawbacks of the related art.

SUMMARY OF THE DISCLOSURE

It is an objective of this disclosure to provide an electrical connection module and a power supply integration structure of a connection interface of the electrical connection module for integration of power or power supply.

To achieve the objective, this disclosure provides an electrical connection module including; a connection body and a terminal structure. The connection body has a jack communicating with the inside of the connection body for installing the terminal structure in the inside the connection body to communicate with the jack. The terminal structure includes a plurality of terminals arranged in two rows, and each row of terminals of the terminal structure has one or more power terminals. The power terminal in one row is defined as a positive pin, and the power terminal in the other row is defined as a negative pin. An end of each row of the power terminal is electrically coupled to a conductive part.

To achieve the objective, this disclosure also provides a power supply integration structure of a connection interface, including: at least one electrical connection module, and a power guide base. The electrical connection module includes a connection body and a terminal structure. The connection body has a jack communicating with the inside of the connection body. The terminal structure is installed in the connection body and communicates with the jack. The power guide base has a first conductive frame and a second conductive frame for the electrical connection module to straddle thereon. The terminal structure includes a plurality of terminals arranged in two rows. The terminals in each row of the terminal structure have one or more power terminals. The power terminal in one row is defined as a positive pin, and the power terminal in the other row is defined as a negative pin. An end of the power terminal in each row is electrically coupled to a conductive part respectively, and each conductive part is in contact with the first conductive frame and the second conductive frame of the power guide base respectively for the power integration.

DESCRIPTION OF THE EMBODIMENTS

The technical contents of this disclosure will become apparent with the detailed description of embodiments accompanied with the illustration of related drawings as follows. It is intended that the embodiments and drawings disclosed herein are to be considered illustrative rather than restrictive.

Figure 1:
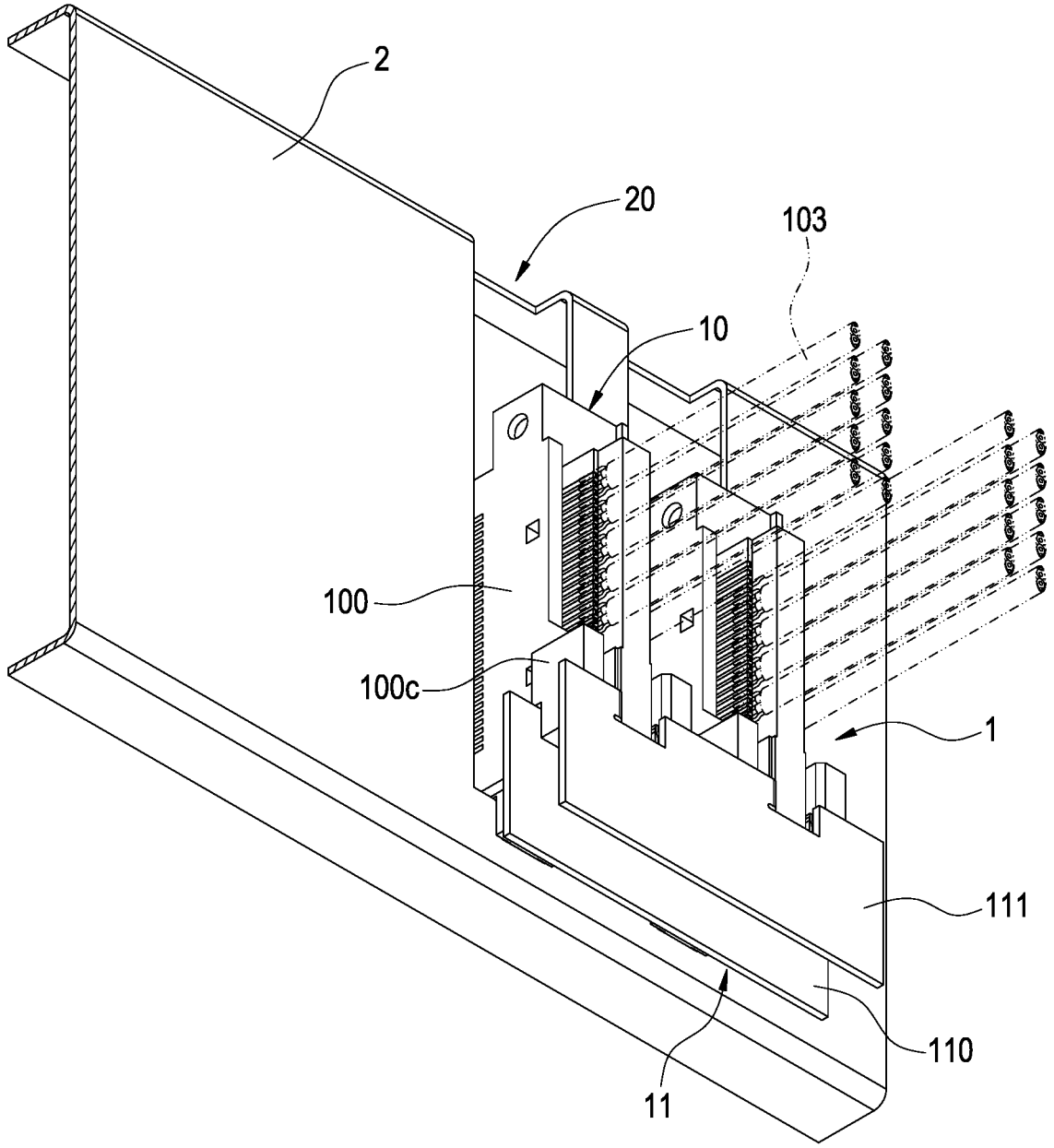
FIG. 1 is a perspective view of this disclosure.
Figure 2:
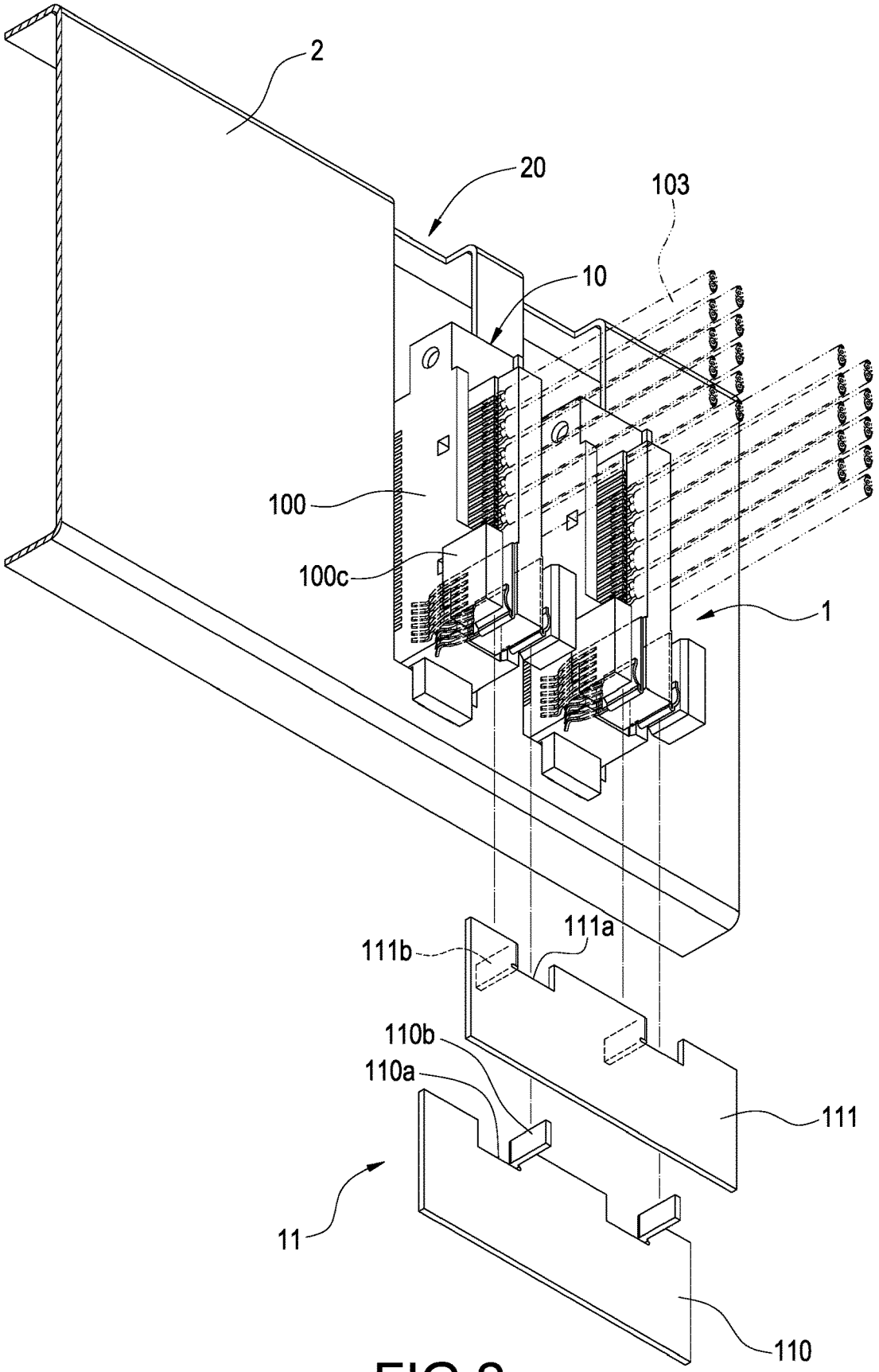
FIG. 2 is a partial exploded view of this disclosure.

With reference to FIGS. 1 and 2 for a perspective view and a partial exploded view of this disclosure respectively, this disclosure discloses an electrical connection module and a power supply integration structure of a connection interface of the electrical connection module. The power supply integration structure 1 of the connection interface is applicable for the inside of a server and may be mounted on a stand 2 between a host system and a data access system (not shown in the figure) in the inside of the server. The power supply integration structure 1 of the connection interface includes at least one electrical connection module 10, and a power guide base 11 provided for connecting the electrical connection module 10 to a power supply. Here uses, but not limited to, two electrical connection modules 10 as an example.

Figure 3:
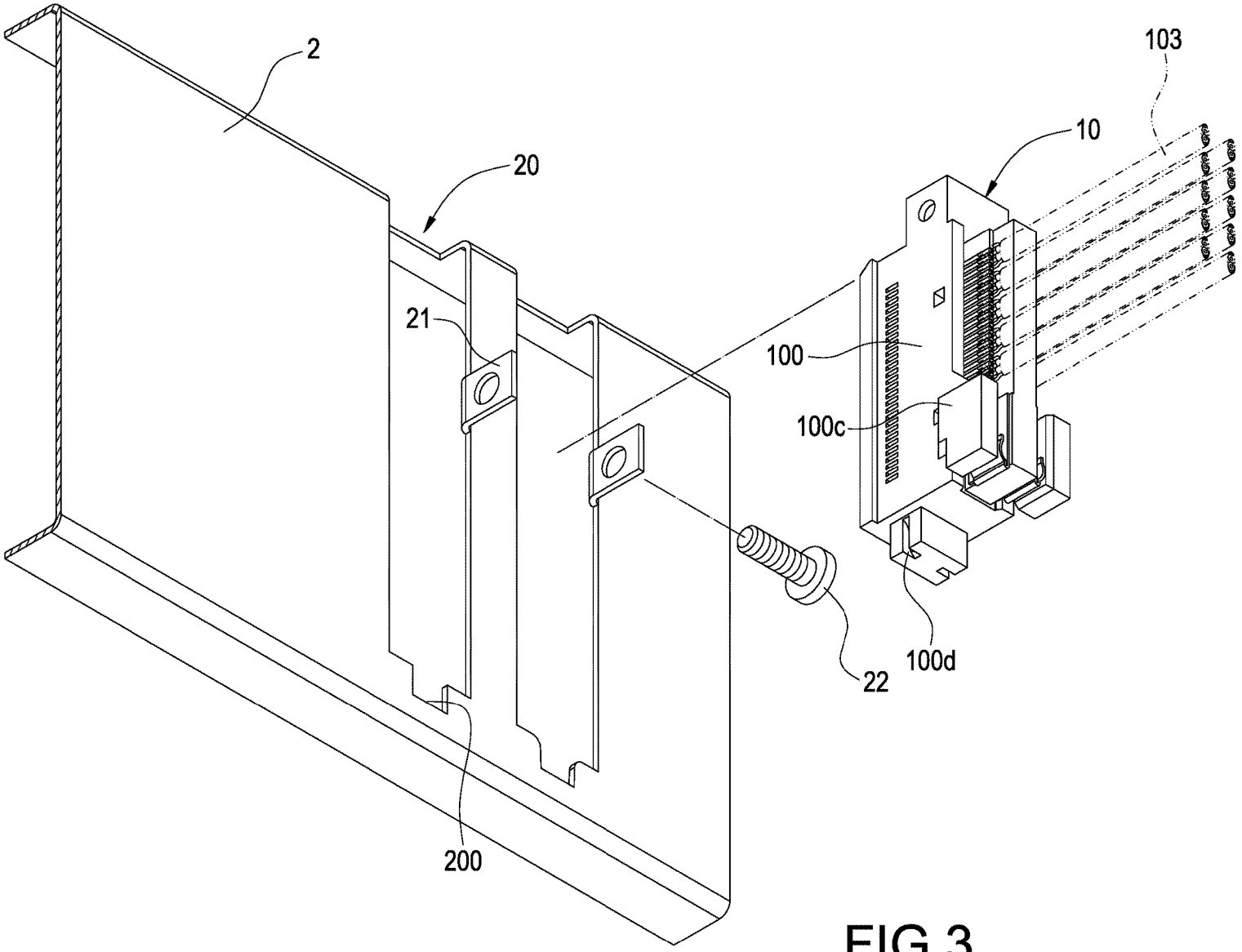
FIG. 3 is an exploded view showing an electrical connection module and an interface and an interface stand of this disclosure.

The electrical connection module 10 is fixed on the stand 2. The stand 2 may have a plurality of mounting holes 20 arranged transversally and spacedly. Each electrical connection module 10 passes through each mounting hole 20 in an erect state and is fixed on the stand 2. In an embodiment of this disclosure as shown in FIG. 3, the stand 2 has at least one flange 21 disposed on a side or the periphery of each mounting hole 20, and a locking element 22 such as a screw passes through the flange 21 to fix the electrical connection module 10 on the mounting hole 20. It is noteworthy that any other equivalent fixing structure may be used to achieve the same effect.

Figure 4:
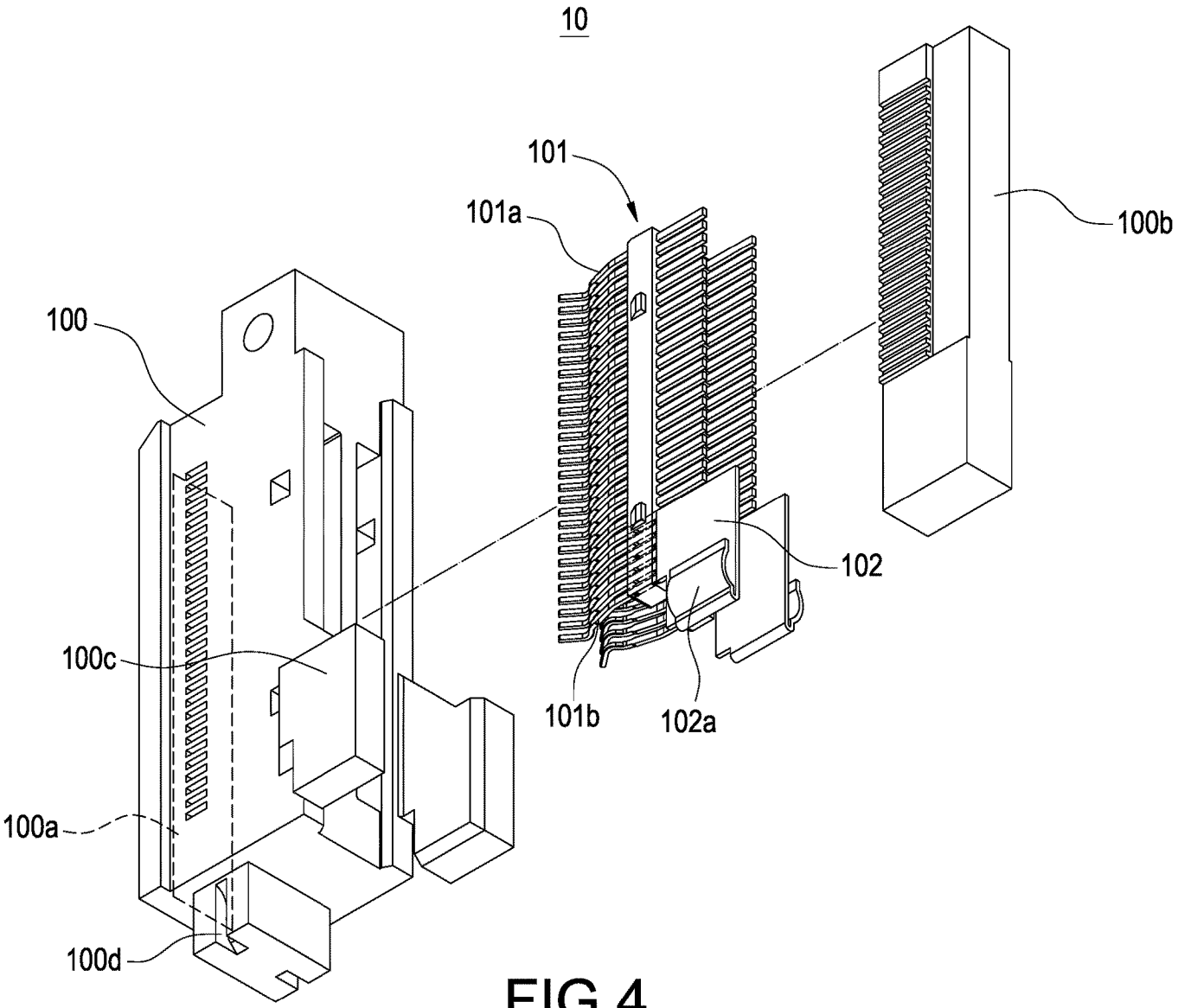
FIG. 4 is an exploded view of an electrical connection module of this disclosure.
Figure 6:
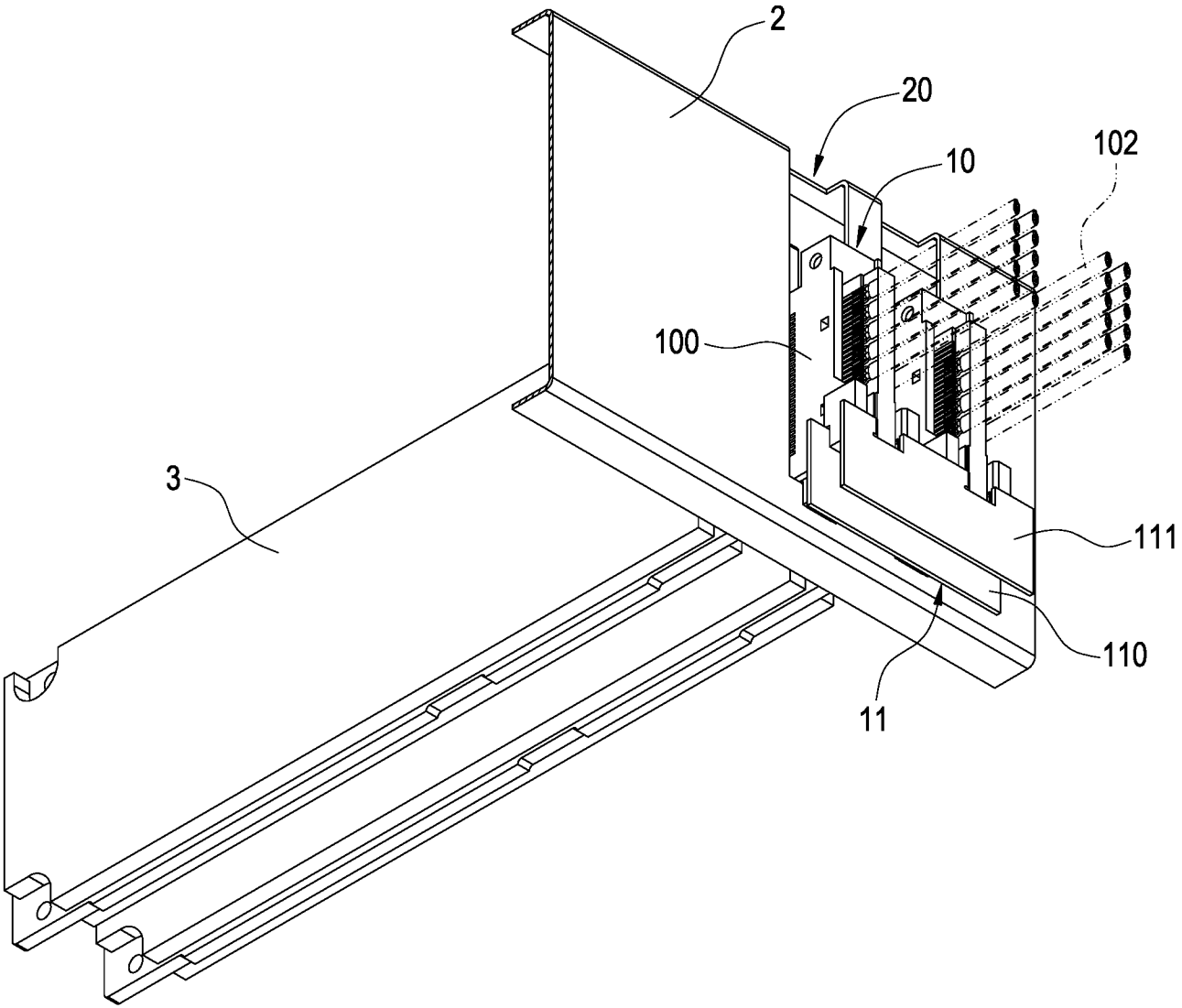
FIG. 6 is a perspective view of this disclosure connected to a data access device.

In FIG. 4, the electrical connection module 10 includes a connection body 100, and a terminal structure 101 installed in the inside of the connection body 100. The connection body 100 has a jack 100*a* communicating with the inside of the connection body 100 for installing the terminal structure 101 in the inside of the connection body 100 to communicate with the jack 100*a*. In FIG. 6, when each electrical connection module 10 is fixed on the stand 2, the data access device 3 on the rear of the stand 2 may pass through the jack 100*a* to couple with the electrical connection module 10 to electrically connect with the terminal structure 101 in the inside of the electrical connection module 10 for data or signal transmissions. The electrical connection module 10 may further include a transmission line group 103 electrically coupled to the ends of the terminal structure 101 to extend and connect with a host system (not shown in the figure) in a server.

In FIG. 4, the terminal structure 101 includes a plurality of terminals 101*a*, 101*b* arranged in two rows (in form of double rows), and each row has a plurality of terminals 101*a* provided for signal transmissions and one or more power terminals 101*b*. The power terminals 101*b* in one row are defined as the positive pins (or power pins), and the power terminals 101*b* in the other row are defined as the negative pins (or ground pins). The ends of the power terminals 101*b* in each row are electrically coupled to a conductive part 102 respectively. The conductive parts 102 are spaced from each other and extended from the connection body 100. The conductive parts 102 may be electrically coupled to each power terminal 101*b* directly, or indirectly coupled between each battery terminal 101*b* and the conductive part 102 through a printed circuit board (PCB). In the embodiment of this disclosure, the quantity of power terminals 101*b* in each row is six. The conductive part 102 is a plate downward extended. The conductive part 102 of each row and the power terminal 101*b* thereof may be integrally formed by a metal stamping process. A side of each conductive part 102 downward extended is bent to form an elastic abutting portion 102*a*. In addition, an end of the terminal structure 101 may be welded with the transmission line group 103 through a wire bonding board 100*b*. The wire bonding board 100*b* is installed on a rear end of the connection body 100 to isolate the two conductive parts 102. In other embodiments, the wire bonding board 100*b* may be configured by a printed circuit board (PCB). Two conductive parts 102 may be isolated by the printed circuit board, or two conductive parts 102 may be isolated by a structure integrally formed and protruding from the rear end of the connection body 100. Thus, the wire bonding board 100*b* may be formed by a plastic part independently as shown in the figure. In other embodiments, the wire boarding board 100*b* may be configured by a printed circuit board, or configured by a printed circuit board and a plastic part. The plastic part may be an independent component or integrally formed with the connection body 100 by plastic injection molding.

Figure 5:
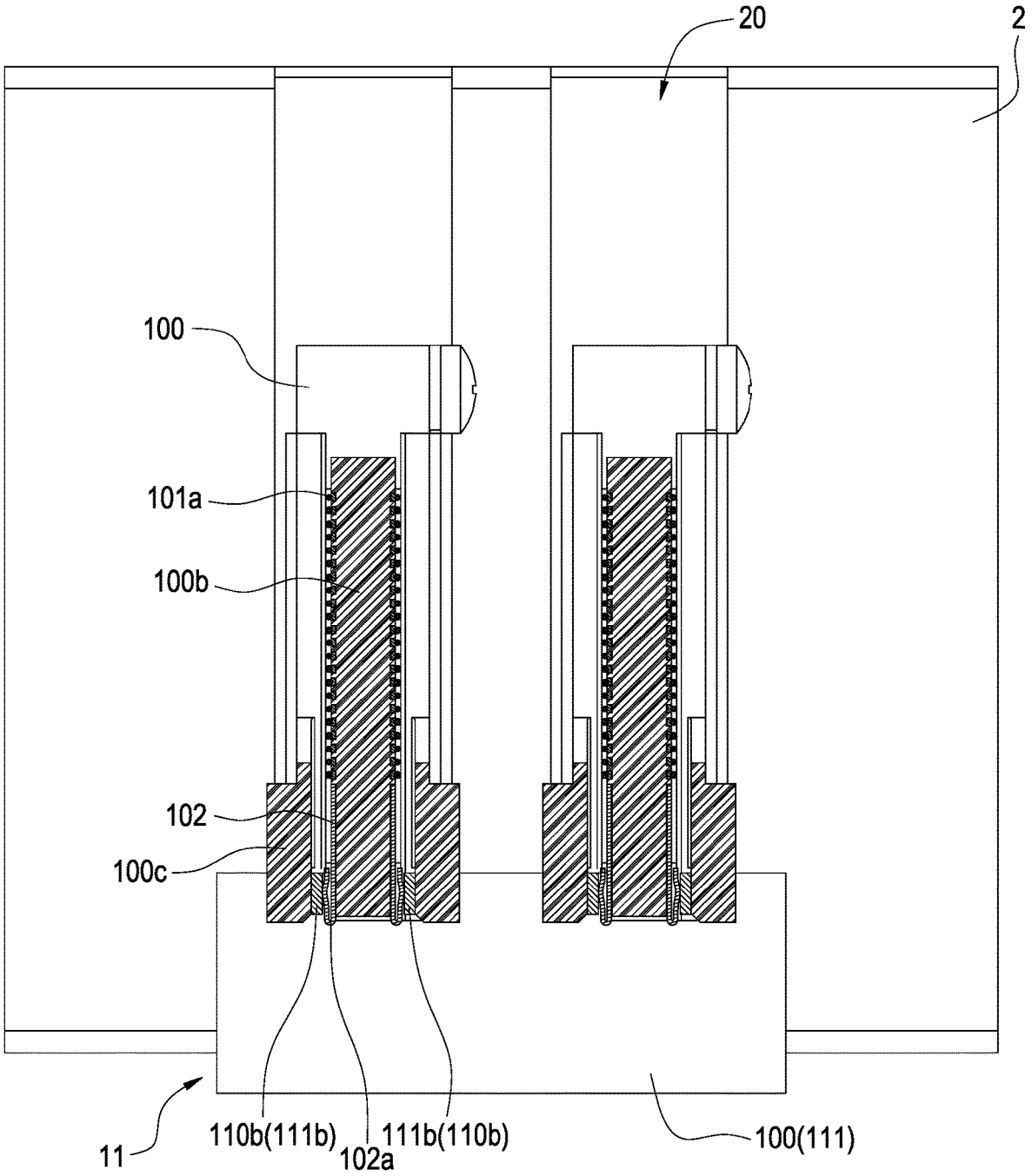
FIG. 5 is a cross-sectional view showing a combined state of this disclosure.

In FIGS. 1 and 2, the power guide base 11 is provided for electrically connecting the two conductive parts 102 of the electrical connection module 10. The power guide base 11 has a first conductive frame 110 and a second conductive frame 111 spaced from each other and installed along the transverse direction of the stand 2. Specifically, in FIG. 2, the first conductive frame 110 has a first engaging slot 110*a* concavely formed thereon corresponding to each electrical connection module 10. The first engaging slot 110*a* has a first conductive portion 110*b* corresponding to one of the conductive parts 102. The second conductive frame 111 also has a second engaging slot 111*a* concavely formed thereon corresponding to each electrical connection module 10. The second engaging slot 111*a* is spaced from and disposed opposite to the first engaging slot 110*a*. The second engaging slot 111*a* has a second conductive portion 111*b* corresponding to the other conductive part 102. The power guide base 11 straddles the first and second conductive frames 110, 111 through the electrical connection module 10 to electrically couple the two conductive parts 102 of the electrical connection module 10 to the first and second conductive frames 110, 111 respectively, so as to provide a power integration for the plurality of electrical connection modules 10 fixed on the stand 2 through the power guide base 11 as shown in FIG. 5.

Further, the connection body 100 may have a stopper 100*c* disposed spacedly on the outer sides of the two conductive parts 102 respectively. In FIG. 5, the stopper 100*c* is spaced apart from the corresponding conductive part 102, and the interval is substantially less than the thickness of the first or second conductive portion 110*b*, 111*b* to achieve the close contact effect. In FIG. 3, the connection body 100 may further have an embedding part 100*d* disposed on the bottom edge of the corresponding mounting hole 20 and an embedding slot 200 is formed on the bottom edge of the mounting hole 20, and the embedding part 100*d* may have a groove matching the thickness of the stand 2 for the embedding part 100*d* to embed in the embedding slot 200, so that the lower end of the connection body 100 may be assembled and fixed to the bottom edge of the mounting hole 20 securely, and the electrical connection module 10 may straddle the first and second conductive frames 110, 111 of the power guide base 11 securely.

The aforementioned structure and assembly constitute the electrical connection module and the power supply integration structure of the connection interface of the electrical connection module.

While this disclosure has been described by means of specific embodiments, numerous modifications and variations could be made thereto by those skilled in the art without departing from the scope and spirit of this disclosure set forth in the claims.

What is claimed is:

1. An electrical connection module, comprising:

a connection body, comprising a jack communicating with an inside of the connection body; and a terminal structure, installed in the inside of the connection body and communicating with the jack, and comprising a plurality of terminals arranged in two rows, and the terminals in each row comprising one or more power terminals, and the power terminal in one row being defined as a positive pin, and the power terminal in the other row being defined as a negative pin, and an end of the power terminal of each of the rows electrically coupled to a conductive part, wherein the conductive part is a plate extended downward, the conductive part comprises an elastic abutting portion bent from a side of the conductive part extended downward, the elastic abutting portion is located on a side of the conductive part and extended upward, the elastic abutting portion overlaps at least a portion of the conductive part, the elastic abutting portion is deformable.

2. The electrical connection module in claim 1, wherein the conductive part of each row is integrally formed with the power terminal thereof.

3. The electrical connection module in claim 1, wherein a quantity of the power terminal is six.

4. The electrical connection module in claim 1, wherein the terminal structure comprises a wire bonding board installed on an end thereof, and the wire bonding board is installed on a rear end of the connection body and located between the conductive parts.

5. The electrical connection module in claim 1, wherein the connection body comprises a stopper disposed on an outer side of the conductive parts respectively and spacedly.

6. A power supply integration structure of a connection interface, the power supply integration structure comprising:

at least one electrical connection module, comprising a connection body and a terminal structure, and the connection body comprising a jack communicating with an inside of the connection body, and the terminal structure installed in the inside of the connection body and communicating with the jack; and a power guide base, comprising a first conductive frame and a second conductive frame, and the electrical connection module straddling thereon;

wherein, the terminal structure comprises a plurality of terminals arranged in two rows, and the terminals in each row of the terminal structure comprises one or more power terminals, and the power terminal in one row is defined as a positive pin, and the power terminal in the other row is defined as a negative pin, and an end of the power terminal in each row are electrically coupled to a conductive part respectively, and each of the conductive parts is in contact with the first conductive frame and the second conductive frame of the power guide base, wherein the conductive part is a plate extended downward, the conductive part comprises an elastic abutting portion bent from a side of the conductive part extended downward, the elastic abutting portion is located on a side of the conductive part and extended upward, the elastic abutting portion overlaps at least a portion of the conductive part, the elastic abutting portion is deformable.

7. The power supply integration structure of the connection interface in claim 6, wherein the first conductive frame comprises a first engaging slot concavely disposed thereon corresponding to the electrical connection module, and the second conductive frame comprises a second engaging slot concavely disposed thereon corresponding to the electrical connection module, and the second engaging slot is spaced from the first engaging slot, the electrical connection module straddles the first conductive frame and the second conductive frame on the first engaging slot and the second engaging slot.

8. The power supply integration structure of the connection interface in claim 7, wherein the first engaging slot comprises a first conductive portion configured to be corresponsive to one conductive part, and the second engaging slot comprises a second conductive portion configured to be corresponsive to the other conductive part, and two conductive parts of the electrical connection module are electrically coupled to the first conductive portion and the second conductive portion respectively.

9. The power supply integration structure of the connection interface in claim 6, further comprising a stand, and the electrical connection module being fixed on the stand.

10. The power supply integration structure of the connection interface in claim 9, wherein the stand comprises a plurality of mounting holes arranged transversally and spacedly, the electrical connection module passes through any one of the mounting holes to be fixed on the stand.

11. The power supply integration structure of the connection interface in claim 10, wherein the connection body comprises an embedding part configured to be corresponsive to a bottom edge of the mounting hole, and an embedding slot is disposed on the bottom edge of the mounting hole and the embedding part is embedded in the embedding slot.

12. The power supply integration structure of the connection interface in claim 11, wherein the embedding part comprises a groove corresponding to a thickness of the stand.

13. The power supply integration structure of the connection interface in claim 9, wherein the first conductive frame and the second conductive frame of the power guide base are spaced from each other and installed along a transverse direction of the stand.

* * * * *